United States Patent [19]

Smith

[11] 4,048,940

[45] Sept. 20, 1977

[54] TROLLING ATTACHMENT FOR OUTBOARD ENGINE

[76] Inventor: William L. Smith, 1156 Blewett Ave., San Jose, Calif. 95125

[21] Appl. No.: 779,165

[22] Filed: Mar. 18, 1977

[51] Int. Cl.[2] ..... B63H 25/48

[52] U.S. Cl. ..... 114/145 A; 415/8

[58] Field of Search ..... 114/145 A, 145 R, 170; 115/17, 18 R, 24.1; 415/8

[56] References Cited

U.S. PATENT DOCUMENTS

| | | | |
|---|---|---|---|
| 2,288,504 | 6/1942 | Weber | 114/145 A |
| 2,787,974 | 4/1957 | Johnson | 114/145 A |
| 2,998,795 | 9/1961 | Downie et al. | 114/145 A |
| 3,136,280 | 6/1964 | Bergum | 114/145 A |
| 3,965,838 | 6/1976 | Uht | 114/145 A |

*Primary Examiner*—Trygve M. Blix

*Assistant Examiner*—Edward M. Wacyra

[57] ABSTRACT

A trolling attachment for an outboard engine includes a strap element for securement to the upper section of an engine housing and a plate member having an axial slot extending inwardly from one end for securement to the lower section of an engine housing. A handle rod is extendable slidably through apertures in a flange element projecting perpendicularly from the strap element and in the plate member. A trolling flap is hingedly secured to the lower surface of the plate member and pivotably mounts the lower extremity of the handle rod. A pin is carried by the flange element that is cooperable with the handle rod for releasably locking the handle rod in a selected vertical position. A lower region of the handle rod is rearwardly offset and given a notch which is cooperable with the plate member for releasably locking the trolling flap in its vertical position.

8 Claims, 3 Drawing Figures

TROLLING ATTACHMENT FOR OUTBOARD ENGINE

BACKGROUND OF THE INVENTION

The invention relates to a trolling attachment for an outboard engine whereby the engine can be maintained at a desired power setting and the speed of the craft reduced for trolling.

The value of trolling attachments enabling one to maintain an outboard engine at a medium or high power setting so as to avoid cut-off of the engine, and permitting a reduction of the speed of the boat to allow trolling has been recognized heretofore. Thus, it has been known to fit outboard engines with trolling attachments which include a trolling flap that can be pivoted between a horizontal position in which the craft can proceed at normal cruising speed and a lowered vertical depending position in which the craft is slowed to trolling speed. However, prior trolling attachments of this character have been complex in requiring a plurality of levers and linkages as in U.S. Pat. 2,548,121 issued Apr. 10, 1951 to P. R. Reid or have required spring members to insure proper pivotal movement of the flap as in U.S. Pat. No. 3,209,716 issued Oct. 5, 1965 or employ an adjusting mechanism including a jack screw and an internally threaded head such as disclosed in U.S. Pat. No. 2,998,795 issued Sept. 5, 1961. Since the environment within which the trolling attachement is to be used tends to accelerate corrosion of its components it will be appreciated that dependence upon a plurality of hinged connections, springs and threaded members creates a susceptibility to jamming and reduced effectiveness of the device.

SUMMARY OF THE INVENTION

It is one object of the invention to provide a trolling attachment for an outboard engine which is simple in construction and avoids the use of springs and threaded members.

It is another object of the invention to provide a trolling attachment which includes a handle rod member operably connected to the trolling flap and configured to cooperate with the flap-mounting element ot effect releasable locking of the flap in its trolling position.

Other objects and advantages of the invention will become readily apparent from the following description of the invention.

According to the present invention there is provided a trolling attachment for an outboard engine comprising in combination:

first attachment means adapted to be detachably secured to an upper section of the housing of an outboard engine and having a first aperture therein dimensioned to slidably receive an elongated handle rod therein;

second plate-like attachment means adapted to be detachably secured adjacent one end thereof to a lower section of the housing of an outboard engine so as to extend substantially horizontally beyond the location of the engine propeller, a second aperture being provided in said plate-like attachment means adjacent the other end thereof dimensioned to slidably receive the handle rod therein;

a trolling flap hingedly connected to the lower surface of said plate-like attachment means inwardly of said second aperture such that said flap is pivotable between a first horizontal position closely adjacent the lower surface of said plate-like attachment and second vertical position spaced rearwardly of the engine propeller, means being provided on said flap for pivotably mounting the lower extremity of the handle rod;

an elongated handle rod of sufficient length to extend through the apertures in said first and second attachment means, said handle rod having a locking notch formed in the lower region thereof cooperable with said plate-like attachment means for releasably locking said trolling flap in its vertically disposed position;

and latch means carried by said first attachment means cooperable with said handle rod for releasably locking said handle rod in a selected vertical position.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
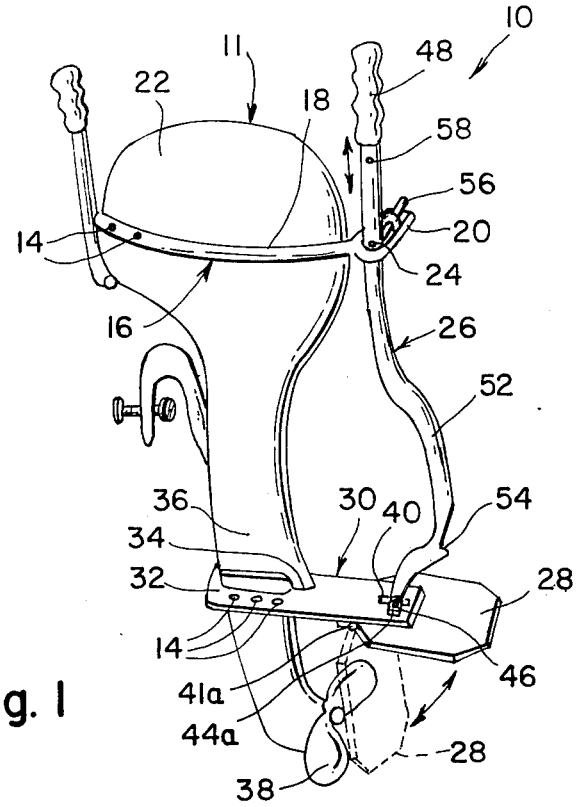
FIG. 1 is a perspective view of a trolling attachment embodying the features of the invention.
Figure 2:
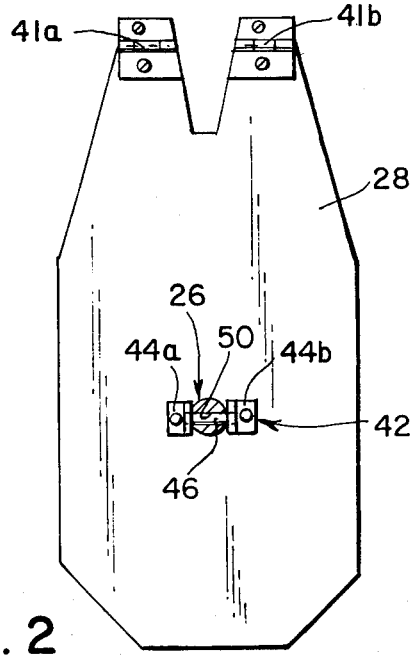
FIG. 2 is a plan view of the lower attachment element of the device.

Referring to the drawings there is shown generally, as indicated by reference numeral 10, a trolling attachment which may be marketed in the form of a kit. The trolling attachment comprises as assemblage of several components and is attachable to the housing 11 of an outboard engine either detachably or permanently by fastening means such as screws 14. Any such screws to be employed in areas below the water line are desirably inserted into countersunk holes therefore to minimize drag.

The trolling attachment includes an upper attachment member 16 which may be a bracket or, as shown, a strap element 18 and a flange element 20 integral therewith and projecting perpendicularly therefrom. The upper attachment member is secured to the upper section 22 of the outboard engine housing. An aperture 24 is formed in the flange and is dimensioned to slidably accommodate the upper region of a handle rod 26 which itself is of sufficient length to extend from the proximity of the upper section of the engine housing to a trolling flap 28 to be described.

A second and lower attachment member 30 is provided in the form of an elongated plate one end 32 of which is given an axially extending slot 34 which is dimensioned to fit about the lower section 36 of the engine housing. As shown the lower attachment member is adapted to encompass the engine housing within which there is positioned the exhaust and gearing for the driving of propeller 38. An aperture 40 is formed adjacent the rear of plate member 30 and is desirably of cruciform configuration as can be seen most clearly from the exploded view of the assembly depicted in FIG. 3. Aperture 40 is of adequate dimension to accommodate the lower extremity of the handle rod slidably therein. The cruciform configuration of the aperture is useful since it is proportioned to receive mounting bracket 42 therein when the handle rod is shifted upwardly as will be hereafter described.

A trolling flap 28 is connected pivotably to the lower surface of the lower attachment member 30 inwardly of aperture 40 such that the flap is pivotable between a first horizontal position as shown in FIG. 1 closely adjacent the lower surface of plate member 30 and a second vertical position shown by dotted line in FIG. 1 so as to be spaced rearwardly of the propeller. The flap is conveniently secured to the lower surface of plate member 30 by a pair of hinge elements 41*a*, 41*b*. A mounting bracket 42 is provided on the upper surface of the trolling flap consisting essentially of a pair of laterally spaced angle bracket elements 44*a*, 44*b* and a pin member 46 carried therebetween. The angle brackets and pin member are dimensioned so as to permit their projection into cruciform aperture 40 of plate member 30. In this manner the flap 28 can be pivoted upwardly into its horizontal position flush against the lower surface of the plate member thereby minimizing drag resistance when the craft is to be propelled at normal cruising speed.

Figure 3:
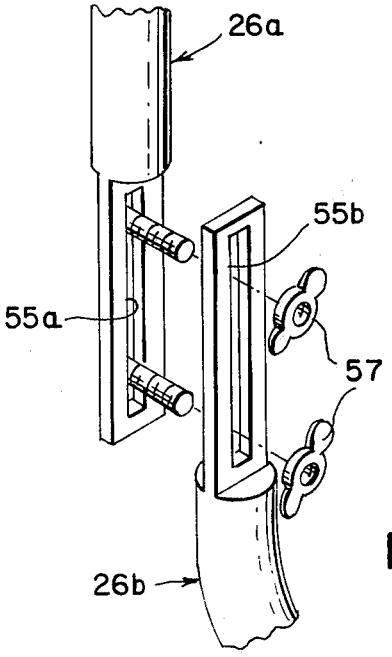
FIG. 3 is an exploded view of the trolling attachment.

As stated above, the trolling attachment assembly includes an elongated handle rod 26. The upper portion of such handle rod may be provided with a hand grip element 48 fabricated of an elastomeric material such as one of the well known synthetic rubbers. The handle rod is of sufficient length to extend through the apertures 24, 40. The lower extremity of the handle rod is given an opening 50 which is dimensioned to rotatably receive the pin member 46 of mounting bracket 42. The handle rod is thus pivotably mounted upon the trolling flap and affords a convenient means for shifting the flap between its horizontal and vertical positions. The handle rod includes a rearwardly offset section 52 in the lower region thereof and a locking notch 54 is formed adjacent the lower end of such offset section. The locking notch is thus adapted to enter aperture 40 when the trolling flap is pivoted into its vertical operating position to releasably lock the flap in such position without need of springs or any threaded elements. By virtue of the arcuate configuration of the lower portion of the handle rod the handle rod easily enters aperture 40 and may be shifted upwardly when the flap is to be moved into its horizontal position. As shown in FIG. 3 the handle rod may be constructed in two sections 26*a*, 26*b*. Such sections are desirably slidable relative to each other so as to enable the trolling attachment of this invention to be adaptable to outboard motors of various makes and sizes. Thus, an axial slot 55*a*, 55*b* may be formed in each section and fastening means 57 such as wing nuts may be employed to lock the sections in the desired relative positions.

Carried by flange element 20 is latching means cooperable with the handle rod to releasably lock the handle rod in a selected vertical position. In the preferred form of the invention a slidable bolt 56 is mounted on the flange element insertable into a selected one of several axially spaced openings 58 formed in the upper portion of the handle rod.

From the foregoing it will be seen that a trolling attachment assembly has been provided which does not rely upon the use of springs or threaded elements in the positioning and/or maintaining of the trolling flap in any selected attitude. The trolling attachment is thus simple in construction, may be easily mounted in place on an engine housing and is not susceptible to reduced operative efficacy as a result of corrosion which can be expected to develop in the customary environment in which the device will be employed.

While a specific embodiment of a trolling attachment for an outboard engine has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A trolling attachment for an outboard engine comprising in combination:

first attachment means adapted to be detachably secured to an upper section of the housing of an outboard engine and having a first aperture therein dimensioned to slidably receive an elongated handle rod therein;

second plate-like attachment means adapted to be detachably secured adjacent one end thereof to a lower section of the housing of an outboard engine so as to extend substantially horizontally beyond the location of the engine propeller, second aperture being provided in said platelike attachment means adjacent the other end thereof dimensioned to slidably receive the handle rod therein;

a trolling flap hingedly connected to the lower surface of said plate-like attachment means inwardly to said second aperture such that said flap is pivotable between a first horizontal position closely adjacent the lower surface of said plate-like attachment and a second vertical position spaced rearwardly of the engine propeller, means being provided on said flap for pivotably mounting the lower extremity of the handle rod;

an elongated handle rod of sufficient length to extend through the apertures in said first and second attachment means, said handle rod having a locking notch formed in the lower region thereof cooperable with said plate-like attachment means for releasably locking said trolling flap in its vertically disposed position;

and latch means carried by said first attachment means cooperable with said handle rod for releasably locking said handle rod in a selected vertical position.

2. A trolling attachment according to claim 1, wherein said first attachment means comprises a strap element and a flange element projecting perpendicularly therefrom, the said first aperture being formed in said flange element.

3. A trolling attachment according to claim 2, wherein said latch means comprises a bolt slidably carried by said flange element the upper portion of said handle rod having at least two axially spaced openings therein dimensioned to slidably receive said bolt.

4. A trolling attachment according to claim 1, wherein said second attachment means comprises an elongated plate one end of which is provided with an axially extending slot dimensioned to accommodate therewithin the lower section of the engine housing, said plate being adapted to be secured to said lower section of the engine housing, and said second aperture in said plate being cruciform in configuration.

5. A trolling attachment according to claim 4, wherein said handle rod mounting means comprises a pair of angle brackets secured to the upper surface of said trolling flap and a pin member carried therebetween said brackets and pin member being dimensioned to extend through said cruciform aperture when the trolling flap is in its horizontal position.

6. A trolling attachment according to claim 5, wherein said handle rod is provided with an opening adjacent the lower extremity thereof dimensioned to receive said pin member therein to thereby permit pivotal mounting of said handle rod on said pin member.

7. A trolling attachment according to claim 6, wherein said handle rod includes a rearwardly offset section in the lower region thereof, said locking notch being formed adjacent the lower end of said offset section.

8. A trolling attachment according to claim 1, wherein the length and width of said trolling flap are at least equal to the blade diameter of the engine propeller.

* * * * *